US005211116A

United States Patent [19]

Schneider

[11] Patent Number: 5,211,116

[45] Date of Patent: May 18, 1993

[54] BOGIE FOR HIGH-SPEED RAIL VEHICLES

[75] Inventor: Richard Schneider, Neuhausen am Rheinfall, Switzerland

[73] Assignee: SIG Schweizerische Industrie-Gesellschaft, Switzerland

[21] Appl. No.: 499,357

[22] PCT Filed: Aug. 8, 1989

[86] PCT No.: PCT/CH89/00146

§ 371 Date: Apr. 27, 1990

§ 102(e) Date: Apr. 27, 1990

[87] PCT Pub. No.: WO90/02068

PCT Pub. Date: Mar. 8, 1990

[30] Foreign Application Priority Data

Aug. 30, 1988 [CH] Switzerland ..... 3223/88

[51] Int. Cl.[5] ..... B61F 5/38

[52] U.S. Cl. ..... 105/168; 105/199.1

[58] Field of Search ..... 105/165, 167, 168, 182.1, 105/199.1, 199.2

[56] References Cited

U.S. PATENT DOCUMENTS

| | | | |
|---|---|---|---|
| 424,089 | 3/1890 | Bosdevex | 105/168 |
| 4,648,326 | 3/1987 | Jackson | 105/168 |
| 4,660,476 | 4/1987 | Franz | 105/168 |
| 4,676,172 | 6/1987 | Bullock | 105/168 |
| 4,679,507 | 7/1987 | Rassain | 105/168 |
| 4,903,613 | 2/1990 | Lang et al. | 105/167 |
| 4,926,756 | 5/1990 | Smith et al. | 105/199.1 |

FOREIGN PATENT DOCUMENTS

| | | | |
|---|---|---|---|
| 0072328 | 2/1983 | European Pat. Off. . | |
| 221667 | 5/1987 | European Pat. Off. . | |
| 0365489 | 4/1990 | European Pat. Off. | 105/168 |
| 834256 | 2/1952 | Fed. Rep. of Germany . | |
| 934453 | 11/1955 | Fed. Rep. of Germany . | |
| 2042458 | 6/1975 | Fed. Rep. of Germany . | |

*Primary Examiner*—Mark T. Le

*Attorney, Agent, or Firm*—Ostrolenk, Faber, Gerb & Soffen

[57] ABSTRACT

A bogie for high speed rail vehicles includes an automatic control device for radially adjusting the wheel sets of the bogie. The automatic control device is mounted on the bogie frame along with a damper and a rotation locking device which connects the automatic control mechanism with the body of the vehicle. The automatic control device includes a pair of levers rotatably mounted on either side of the bogie frame. The levers are interconnected in a torsion proof rigid manner, for example, by a rigid pipe.

8 Claims, 3 Drawing Sheets

BOGIE FOR HIGH-SPEED RAIL VEHICLES

BACKGROUND OF THE INVENTION

The present invention relates to a bogie for high-speed rail vehicles.

In the prior art, devices are known which are intended to prevent sinusoidal running of the wheel sets of a rail vehicle (DE-PS 934 453).

Bogies of rail vehicles are also known whose set of wheels are guided in parallel using means which are also known in order to ensure stable straight travel by means of a stiff to rigid wheel set guiding in the longitudinal direction of the vehicle, in particular in high-speed vehicles (DE-PS 834 256). By the additional mounting of rolling dampers, the turning-out resistance between bogie and carriage body can be increased and disadvantageous side effects, which are produced on a straight track due to the rotary oscillations arising from rolling, can be thus effectively damped (DE-PS 2 042 458). Although bogie vehicles thus equipped do run in a sufficiently stable manner at high speeds, in bends they exhibit unacceptably high wheel/rail wear.

Relatively new developments attempt to unite these contrary requirements of stable running at high speeds and low wear in the bends, in particular by the radial adjustment of the sets of wheels towards the center point of the bend during travel round bends. To this end, hitherto, two modes of operation known in the prior art have been used, in particular mutual automatic control (EP-0 221 667) or constrained control of the wheel sets from the carriage body (EP-0 072 328). The disadvantage of both embodiments has been that the wheel sets are subject to a certain amount of faulty control especially when running into and out of the bend, which also leads to wheel/rail wear and impairs running on bends. The most recent practical experiments have shown, furthermore, that known controls for wheel sets already respond to the small, rapid turning-out movements which arise inside the track clearance as a result of sinusoidal running. This too leads to faulty controls of the wheel sets, which reduce stability and cause wear.

To optimize a bogie in terms of running stability and travelling round bends, the following are therefore of critical importance:

- the bending resistance between the two wheel sets
- the shearing strength between the two wheel sets
- the resistance to turning-out between the bogie and the carriage body.

SUMMARY OF THE INVENTION

The object of the invention, then, is to create a bogie for a high-speed rail vehicle, which even at high travel speeds exhibits stable vehicle running which spares the track by virtue of the radial adjustment of the wheel sets only during travel on bends.

The object is achieved by separating the dynamic movements due to sinusoidal running from the quasi-static movements of the bend travel.

DESCRIPTION OF THE DRAWINGS

The invention, as well as its objects, advantages and features will be more readily understood from the following detailed description, when considered in conjunction with the appended drawings, in which.

DESCRIPTION OF THE PREFERRED EMBODIMENTS

Figure 1:
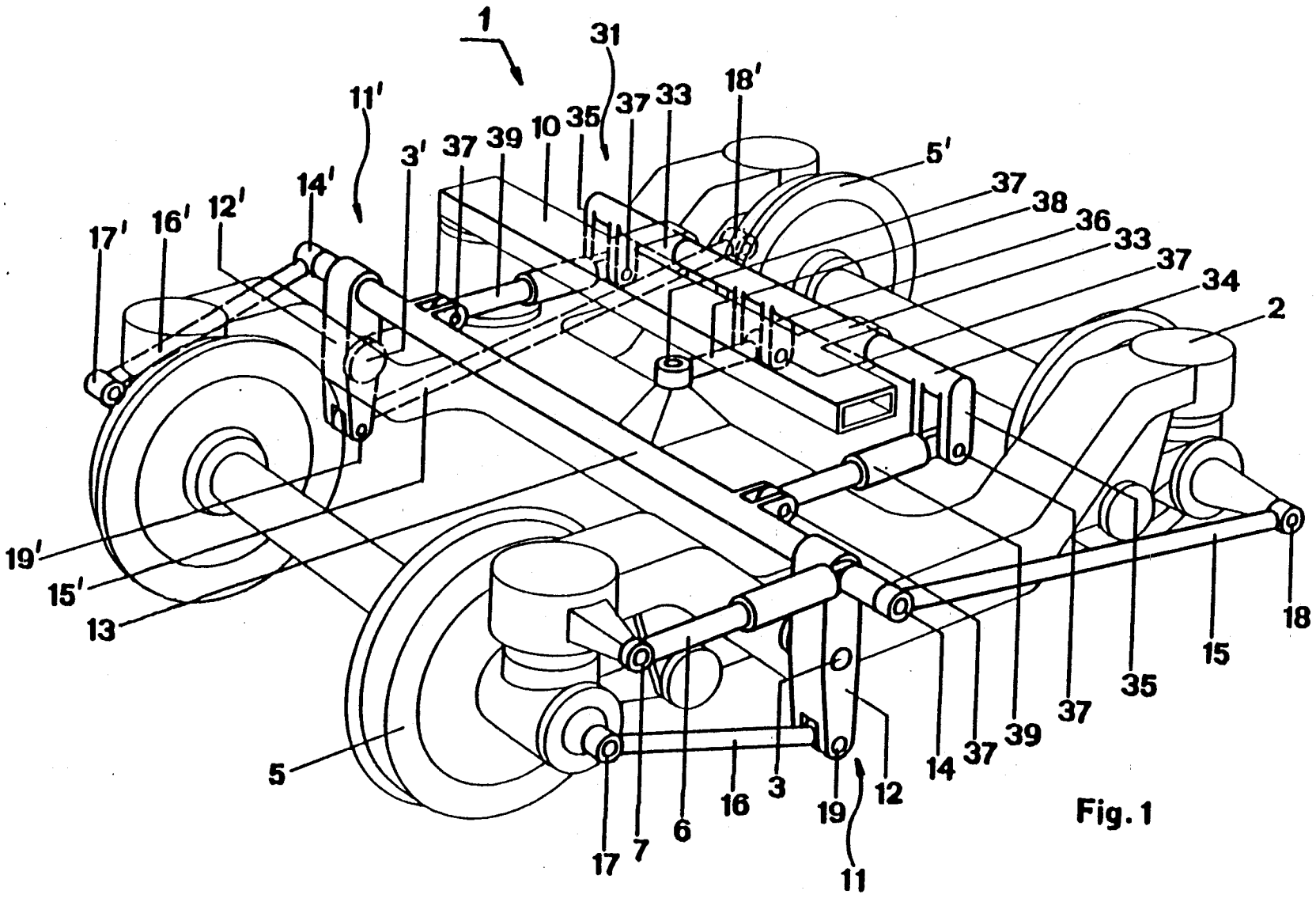
FIG. 1 is a perspective diagram of the construction according to the invention of a bogie with a control device for the mutual automatic control of the wheel sets, provided with restraining means and a decoupling device.

A first example of application is illustrated in FIG. 1, wherein a bogie 1 is provided with a respective automatic control device 11, 11' for the mutual automatic control of the two wheel sets 5, 5'. In this case, a bogie frame 2 is on the one side supported on the wheel sets 5, 5' by known guide, suspension and damping means, and on the other side the bogie frame 2 carries and guides with similar means of the secondary spring stage an associated carriage body 10. The bogie frame 2 is provided with two rotary bearings 3, 3', in each of which is mounted a respective steering lever 12, 12' of the automatic control devices 11, 11' mounted on both sides of the bogie frame 2. The two steering levers 12, 12' are connected together by a torsion-resistant and bending-resistant tube 13 in the region of their two upper pivotal points 14, 14'. Furthermore, in the control device 11, the upper pivot point 14 of the steering lever 12 is connected to the wheel set 5' at a coupling point 18 by means of a steering rod 15, and a lower pivotal point 19 of the steering lever 12 is connected to the wheel set 5 at a coupling point 17 by means of a steering rod 16. Conversely, in the control device 11' the upper pivot point 14' of the steering lever 12' is connected to the wheel set 5 at a coupling point 17' by means of a steering rod 16', and a lower pivot point 19' of the steering lever 12' is connected to the wheel set 5' at a coupling point 18' by means of a steering rod 15'. The control device 11, 11' represents the geometric coupling together of the two wheel sets 5, 5' for the purpose of mutual automatic control when travelling round bends.

For damping the dynamic rotary movements inside the track clearance, which arise from the sinusoidal running of the wheel sets 5, 5', at least one of the control devices 11 or 11' is provided with additional restraining means 6. As restraining means 6, at least one damper, which preferably has a dry friction characteristic line, is provided on the bogie frame 2, e.g. at the upper pivot point 14 or 14' between the steering lever 12 or 12' and a coupling point 7. The coupling point on the left in FIG. 1 is not shown.

Alternatively, the restraining means 6 in the form of at least one damper with a dry friction characteristic line may lead to the bogie frame 2 direct from the torsion-resistant and bending-resistant tube 13, e.g. mounted in its center.

Furthermore, the automatic control device 11, 11' for the damping of the rolling movements of the bogie 1 between the latter and the carriage body 10 is provided with a rotation locking device 31, which limits rotation hydraulically with mechanical decoupling of the damping effect for all directions of movement except for rotation about a vertical axis.

To this end, a rigid connecting shaft 34 is mounted on the carriage body 10 in two rotary bearings 33. Two outer levers 35 and one inner lever 36 are fixed to the connecting shaft 34. A rolling damper 39 is mounted between each outer lever 35 and the torsion-resistant and bending-resistant tube 13 of the automatic control device 11, 11' via respective pivot points 37.

The inner lever 36 of the connecting shaft 34 is again connected to the bogie frame 2 by means of a rigid connecting rod 38 via analogous pivot points 37.

Figure 2:
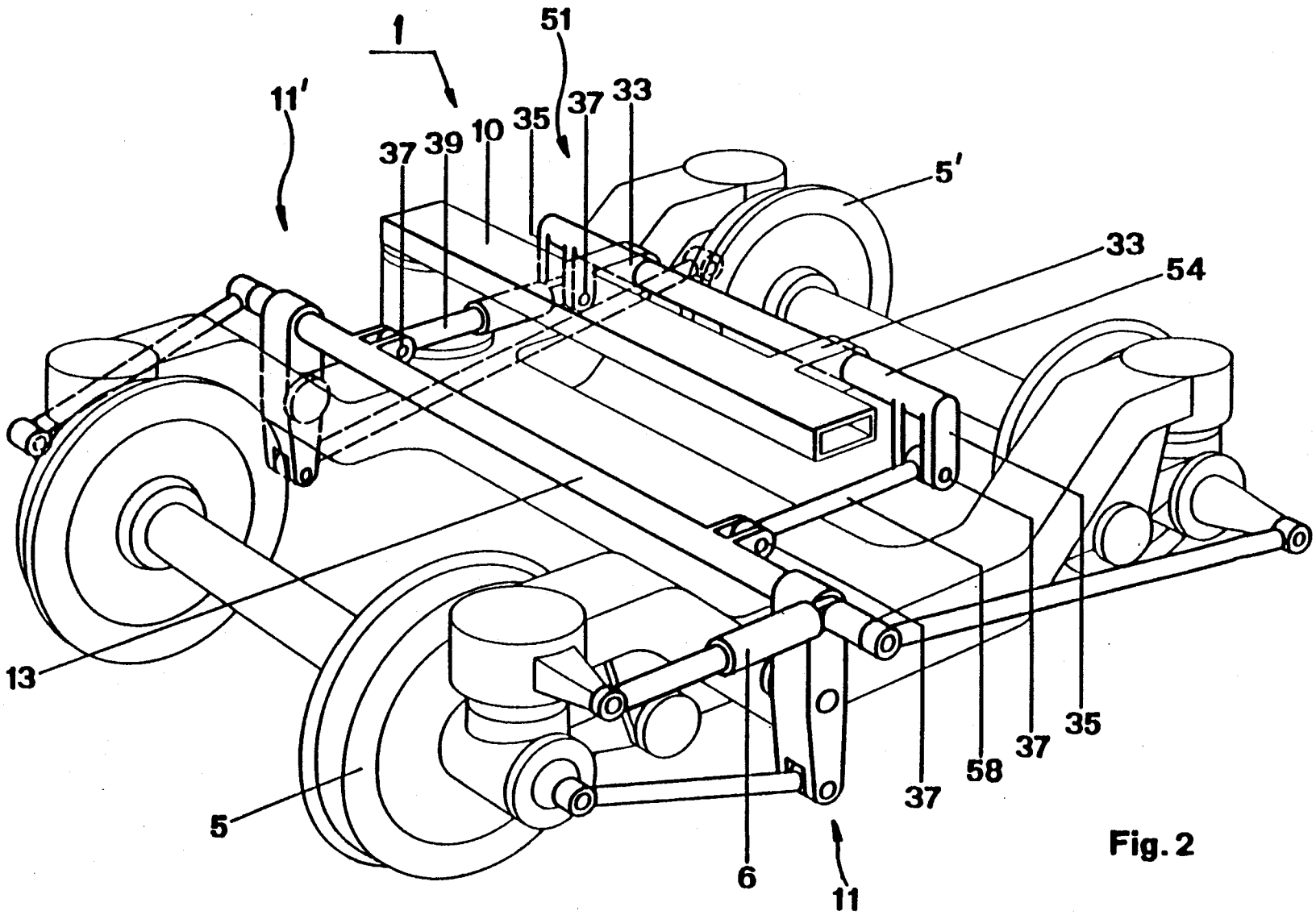
FIG. 2 is a perspective diagram of a bogie similar to that of FIG. 1, with a variant of the decoupling device.

FIG. 2 shows a simplified variant of the decoupling device of a bogie equipped with a control device for mutual automatic control of the wheel sets and restraining means.

In this case, an automatic control device 11, 11' described under FIG. 1 is combined with restraining means 6, which damps the dynamic rotary movements of the wheel sets 5, 5', which arise from their sinusoidal running.

To damp the rolling movements of the bogie 1 between the latter and the carriage body 10, the automatic control device 11, 11' is provided with a rotation locking device 51, which limits rotation hydraulically with mechanical decoupling of the damping effect for all directions of movement, except for rotation about a vertical axis.

To this end, a rigid connecting shaft 54 having two outer levers 35 is mounted on the carriage body 10 in two rotary bearings 33. On the one side, a hydraulic rolling damper 39 is mounted between one of the outer levers 35 and the torsion-resistant and bending-resistant tube 13 of the automatic control device 11, 11' via the respective pivot points 37, and on the other side a rigid connecting rod 58 is mounted between the other outer lever 35 and the torsion-resistant and bending-resistant tube 13.

The restraining means 6 thus mounted effect a combined steering and rotation locking, and in the mutual automatic control of the wheel sets, unite the contrary requirements of stable-running straight travel and track-sparing travel round bends with a minimum requirement of hydraulic dampers.

As an alternative, the torsion-resistant and bending-resistant tube 13 shown in FIGS. 1 and 2 can also be mounted, according to the structural requirements of the bogie 1, in the region of the rotary bearings 3, 3' or at the lower pivot points 19, 19', which connect the two steering levers 12, 12' together.

Figure 3:
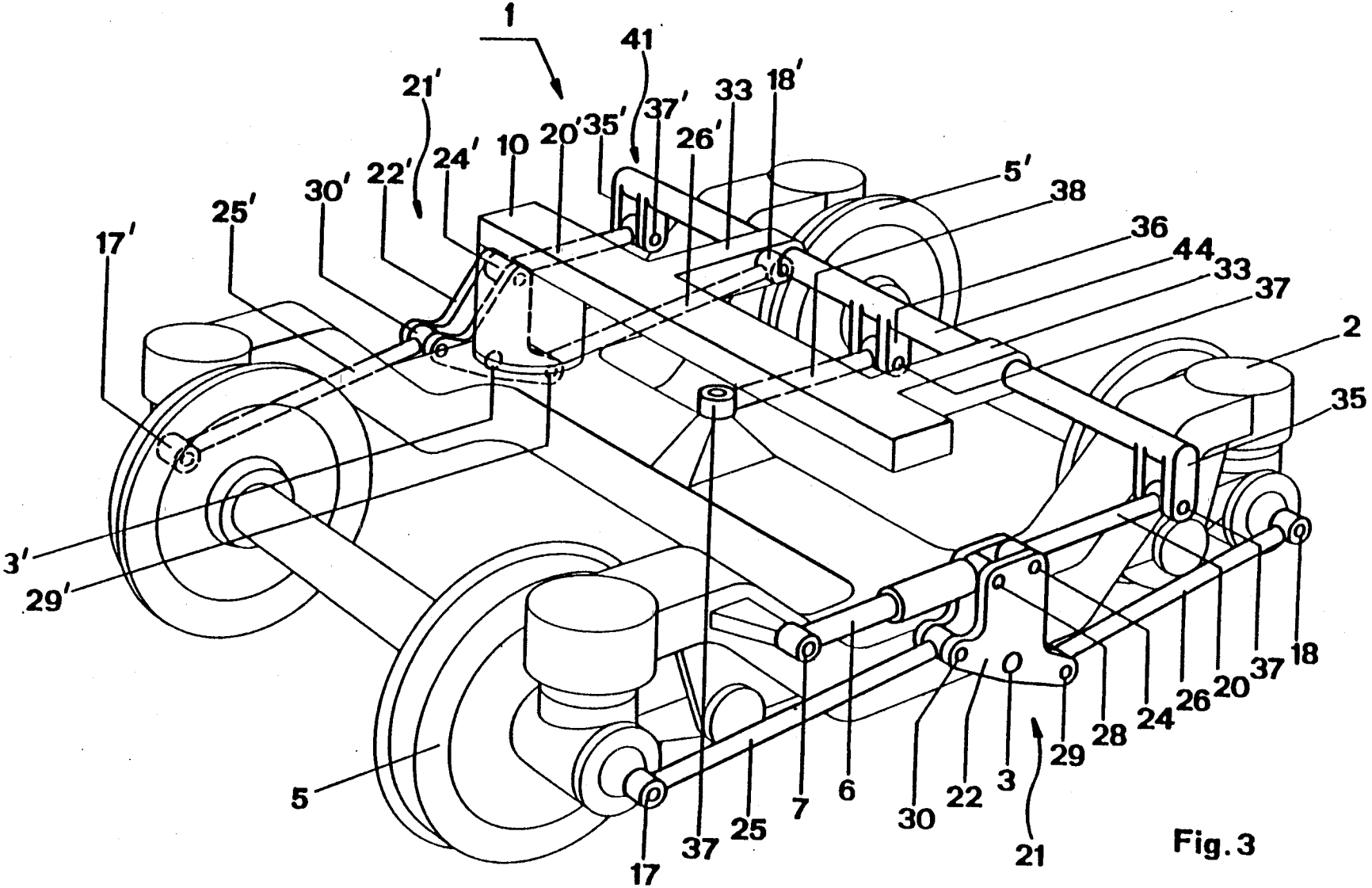
FIG. 3 is a perspective diagram similar to FIG. 1 and 2 of a bogie with a control device for the constrained control of the wheel sets from the carriage body, provided with restraining means and a decoupling device.

A further example of application is shown in FIG. 3, in which a bogie 1 with a respective constrained control device 21, 21' for constrained control of the two wheel sets 5, 5' from the carriage body is provided. In this case, a bogie frame 2, provided on the one side with known guide, suspension and damping means, is supported on the wheel sets 5, 5', and on the other side this bogie frame 2 carries and guides with similar means of the secondary spring stage an associated carriage body 10. The bogie frame 2 is provided with two rotary bearings 3, 3', in each of which a steering lever 22, 22' of the constrained control devices 21, 21' mounted on both sides of the bogie frame 2 is mounted. In each control device 21, 21', a respective central pivotal point 30, 30' of the steering lever 22, 22' is connected to the wheel set 5' at a coupling point 17, 17' by means of a steering rod 25, 25' and a respective lower pivot point 29, 29' of the steering lever 22, 22' is connected to the wheel set 5 at a coupling point 18, 18' by means of a steering rod 26, 26'.

Furthermore, a respective upper pivot point 24, 24' of the steering lever 22, 22' is connected to a respective outer lever 35 of a rotation locking device 41 mounted on the carriage body via the pivot points 37 by means of a respective steering rod 20, 20'. The rotation locking device consists of a connecting shaft 44 mounted on the carriage body in two rotary bearings 33, the inner lever 36 of said connecting shaft 44 being again connected to the bogie frame 2 via the guide points 37 by means of a rigid connecting rod 38.

Thus the constrained control device 21, 21' represents the geometric coupling of the two wheel sets 5, 5' to the carriage body 10 for the purpose of a constrained control from the carriage body when travelling round bends.

To damp the dynamic rotary movements inside the track clearance, which arise from the sinusoidal running of the wheel sets 5, 5', at least one of the control devices 21 or 21' is provided with additional restraining means 6. As restraining means 6, at least one damper, preferably having a dry friction characteristic line, is provided on the bogie frame, e.g. on the upper pivot point 28 between the steering lever 22 or 22' and a coupling point 7.

Simultaneously, the quasi-static turning-out movements such as arise during travel on bends between the carriage body 10 and the bogie 1, are permitted by the restraining means 6 mounted in combination with the rotation locking device 41, and the wheel sets 5, 5' are constantly adjusted towards the bend central point, as by the constrained control device 21, 21' during travel on bends.

The restraining means 6 thus mounted effect a combined steering and rotation locking and unite, in the constrained control of the wheel sets from the carriage body, the contrary requirements of stable-running straight travel and track-sparing travel round bends, while requiring a minimum of hydraulic dampers.

The rotation locking device 41 mounted on the carriage body 10 additionally effect the mechanical decoupling of the hydraulic rotation locking for all directions of movement, except rotation about a vertical axis.

Due to the respective mechanical decoupling of the hydraulic rotation locking with the rotation locking devices 31, 41, 51, e.g. some longitudinal movements, such as may arise from elasticities in the secondary spring stage between bogie 1 and carriage body 10, have no effect on the rest of the system.

Omission of the connecting rod 38 of the mechanical decoupling, on the other hand , would lead, under the effect of the longitudinal movements mentioned, to an uncontrolled, essentially parallel movement of the wheel sets 5, 5' relative to one another in the track axis.

By the mounting of a control device with restraining means and a decoupling device, a rotation locking effect about the vertical axis is used to avoid faulty control of the wheel sets and at the same time to ensure running stability of the bogie even at high speeds.

The control device provided with restraining means represents, in the mutual automatic control, the geometric coupling together of the wheel sets of a bogie. The variant of a constrained control on the carriage body side provided with restraining means represents the geometric coupling of the wheel set of a bogie with the carriage body and reacts only to the turning-out movement between bogie and carriage body as a result of travelling round bends.

Due to its construction according to the invention, the control device provided with restraining means for both named modes of operation is automatically in a position to distinguish whether this turning-out movement arises from travelling round a bend or from rolling due to sinusoidal running.

Thus the large, slow turning-out movements which arise in travelling round bends are translated by the control device into a radial adjustment of the wheel sets towards the bend center point. In the region of the small, rapid turning-out movements, such as occur due to sinusoidal running inside the track clearance, the control device is locked, however, by the restraining means provided.

The restraining means are in turn mounted in combination with a decoupling device, which effects decoupling of the restraining means for all directions of movement, except in the rotation of the bogie about its vertical axis.

The restraining means have the feature of a dry friction characteristic line and thus increase the rotation resistance between bogie and carriage body. Thus the dynamic rotary movements inside the track clearance, arising from sinusoidal running, are damped both during travelling in a straight line and round bends, and to avoid faulty controls of the wheel sets, these movements are not transmitted to the control device, while the quasi-static turning-out movements during travelling round bends are unaffected by the restraining means.

Such track-sparing bogies fulfil a long-standing, unsatisfied requirement, in that they unite contrary requirements and have good running stability at high speeds and reduce wear during travelling on bends to a minimum.

I claim:

1. A bogie for a high speed rail vehicle of the type having a carriage body, the bogie comprising:
- a frame;
- a pair of wheel sets mounted on the frame;
- automatic control means for selectively controlling movement of the wheel sets in predetermined directions;
- restraining means for dampening dynamic movements of the wheel sets, the restraining means being mounted between the automatic control means and the frame;
- and a rotation locking device for dampening rolling movement of the bogie connected between the automatic control means and the carriage body.

2. A bogie in accordance with claim 1, in which the automatic control means includes a pair of steering levers rotatably mounted on either side of the frame and a torsion-resistant and bending-resistant tube interconnecting the levers.

3. A bogie in accordance with claim 2, in which respective first steering rods are provided for connecting an upper pivot point of each lever to one wheel set and respective second steering rods are provided for connecting a lower pivot point of each lever to the other wheel set.

4. A bogie in accordance with claim 1, in which the restraining means includes a dry friction characteristic line.

5. A bogie for a high speed rail vehicle of the type having a carriage body, the bogie comprising:
- a frame;
- a pair of wheel sets mounted on the frame;
- automatic control means for selectively controlling movement of the wheel sets in predetermined directions;
- restraining means for dampening dynamic movements of the wheel sets, the restraining means being mounted between the automatic control means and the frame;
- and a rotation locking device for dampening rolling movement of the bogie connected between the automatic control means and the carriage body, the rotation locking device comprising
- a shaft rotatably mounted on the carriage body, the shaft having two outer levers and an inner lever;
- means including a damper connecting each outer lever to the automatic control means; and
- means including a connecting rod for pivotally connecting the inner lever to the frame.

6. A bogie for a high speed rail vehicle of the type having a carriage body, the bogie comprising:
- a frame;
- a pair of wheel sets mounted on the frame;
- automatic control means for selectively controlling movement of the wheel sets in predetermined directions;
- restraining means for dampening dynamic movements of the wheel sets, the restraining means being mounted between the automatic control means and the frame;
- and a rotation locking device for dampening rolling movement of the bogie connected between the automatic control means and the carriage body, the automatic control means comprising
- a pair of steering levers rotatably mounted on either side of the frame and having an upper pivot point, a lower pivot point and a central pivot point intermediate the upper and lower pivot points;
- a first steering rod connecting the central point of each steering lever to one wheel set;
- a second steering rod connecting the lower pivot point of each steering lever to the other wheel set; and
- a third steering rod connecting the upper pivot point of each steering lever to the rotation locking device.

7. A bogie in accordance with claim 6, in which the rotation locking device includes:
- a shaft rotatably mounted on the carriage body, the shaft having two outer levers and an inner lever;
- means including a damper connecting each outer lever to the automatic control means; and
- means including a connecting rod for pivotally connecting the inner lever to the frame.

8. A bogie in accordance with claim 7, in which the restraining means includes a dry friction characteristic line.

* * * * *